US010405679B2

(12) United States Patent
Rowland

(10) Patent No.: US 10,405,679 B2
(45) Date of Patent: Sep. 10, 2019

(54) CUSHION SYSTEM AND METHOD

(71) Applicant: Dominique Rowland, Glendale Heights, IL (US)

(72) Inventor: Dominique Rowland, Glendale Heights, IL (US)

( * ) Notice: Subject to any disclaimer, the term of this patent is extended or adjusted under 35 U.S.C. 154(b) by 51 days.

(21) Appl. No.: 14/937,871

(22) Filed: Nov. 10, 2015

(65) Prior Publication Data

US 2018/0092474 A1 Apr. 5, 2018

Related U.S. Application Data

(63) Continuation of application No. 13/843,835, filed on Mar. 15, 2013.

(51) Int. Cl.

| | |
|---|---|
| ***A47C 27/08*** | (2006.01) |
| ***A47G 9/10*** | (2006.01) |
| ***A47C 7/38*** | (2006.01) |

(52) U.S. Cl.

CPC ..... *A47G 9/10* (2013.01); *A47C 7/383* (2013.01); *A47C 27/086* (2013.01)

(58) Field of Classification Search

CPC ..... A47C 27/08

USPC ..... 5/644, 640, 689, 652.2, 702, 940, 654

See application file for complete search history.

(56) References Cited

U.S. PATENT DOCUMENTS

| | | | | |
|---|---|---|---|---|
| 4,243,754 | A * | 1/1981 | Swan, Jr. | C08J 9/32 264/223 |
| 5,070,558 | A * | 12/1991 | Fenley | A47G 9/10 5/490 |
| 5,363,524 | A * | 11/1994 | Lang | A47G 9/10 5/640 |
| 2008/0267540 | A1* | 10/2008 | Ashworth | A45C 3/00 383/81 |
| 2015/0157134 | A1* | 6/2015 | Ko | A47C 20/027 5/655.9 |

* cited by examiner

*Primary Examiner* — Frederick C Conley
(74) *Attorney, Agent, or Firm* — Anne K. McGovern Burkhart

(57) ABSTRACT

A closed cushion system including a device for selectively opening a connection between adjacent fixed, pre-filled chambers is set forth. The connection selectively facilitates flow of a fill material between the pre-filled chambers in order to selectively alter the firmness of the pre-filled chambers.

10 Claims, 10 Drawing Sheets

Front

BACK

CUSHION SYSTEM AND METHOD

CROSS-REFERENCE TO RELATED APPLICATION

This application claims the benefit of U.S. provisional patent application No. 61/658,447 entitled "Adjustable Travel Pillow," filed on Jun. 12, 2012.

TECHNICAL FIELD

The present disclosure relates to a cushion system and method. More particularly, the present disclosure relates to an adjustable cushion system and method, such as, for example, a travel pillow and a method for adjusting a travel pillow.

BACKGROUND

Modern day travelers can cross the globe, achieving travel itineraries never dreamed of by travelers in the ancient world. One problem associated with travel has remained throughout the centuries. Travelers need to remain comfortable in order to endure their journeys. Numerous improvements in early travel involved padded compartments or seats, and hanging straps, used to lessen the jostling experienced by travelling over rough roads.

Modern travel is far more comfortable, due to improvements in road and rail travel, as well as the availability of airplanes. In fact, travelers can even sleep during travel on most modern devices. To this end, cushion systems, such as travel cushions and pillows, have become devices of interest to modern travelers and device manufacturers.

For example, US patent application number 20060123548-2 discusses an adjustable pillow. Based on the hydraulic effect of Pascal's Principle that an enclosed fluid under pressure exerts that pressure throughout its volume and against any surface in which it is contained, the device is a multi-chambered hydraulic pillow using differently shaped and sized, variably elastic internal chambers combined with a plurality of internal valves which automatically control, communicate, balance and contain the flows of the liquid and differences in pressure and resulting changes in the external dimensions provided by the changes in the variably elastic flexible chambers.

Since fluid or air compartments used alone or in combination to form a cushion can be either too firm or too squishy, other efforts have been directed to cushions with movable material, such as, for example, U.S. Pat. No. 6,691,352 to Wang.

The Wang patent discusses an improved adjustable pillow that includes a first pillow body which has a first opening and a second pillow body disposed at a selected location in the first opening. The first and second pillow bodies have a plurality of stuffing materials held therein. A user may adjust the pillow to a height and curvature desired by shuffling the stuffing materials between the first and second pillow body and then wrap and fold the second pillow body to form a stable state for use. The second pillow body may be used to support the user's neck to conform ergonomics and to enable the user to get the most comfortable sleep.

SUMMARY

One embodiment constructed in accordance with the principles herein relates to a closed cushion system including a device for selectively opening a connection between adjacent fixed, pre-filled chambers. The connection selectively facilitates flow of a fill material between the pre-filled chambers in order to selectively alter the firmness of the pre-filled chambers.

The fill material can be formed from one or more suitable materials, such as, for example, micro beads, herbals seeds, or any other suitable material. The cushion system can include at least one additional pre-filled chamber connected to the pre-filled chambers. Alternatively, the cushion system can include at least one additional chamber connected to the pre-filled chambers for offloading the fill material from the pre-filled chambers.

Another embodiment constructed in accordance with the principles herein relates to an adjustable fill system for transferring fill material in a closed system. The adjustable fill system includes adjacent chambers pre-filled with the fill material. An expandable connecting mechanism is disposed between the adjacent chambers. The expandable connecting mechanism is selectively expanded via a control provided on the system.

At least part of the expandable connecting mechanism of the adjustable fill system can be disposed on an exterior of the system. The expandable connecting mechanism can include an elastic assembly including a lockable member. The lockable member can be further defined by a lockable bungee cord. An inlet and an outlet can be provided for adjusting the lockable bungee cord of the expandable connecting mechanism.

A method constructed in accordance with the principles herein relates to adjusting fill material volume between chambers in a fixed, closed system. The method includes the following steps. A first chamber is prefilled with a fill material. A second chamber is prefilled with the fill material. The first and second chambers are sealed to form the closed system. A selectively operable system is inserted between the first and second chambers. The fill material is selectively movable by selective operation of the selectively operable system to adjust the firmness of the chambers of the system.

The foregoing and other features and advantages of the present disclosure will become further apparent from the following detailed description of exemplary embodiments, read in conjunction with the accompanying drawings. The drawings are not to scale. The detailed description and drawings are merely illustrative of the principles herein rather than limiting, the scope of the disclosure being defined by the appended claims and equivalents thereof.

DETAILED DESCRIPTION OF THE EXEMPLARY EMBODIMENTS

Figure 1:
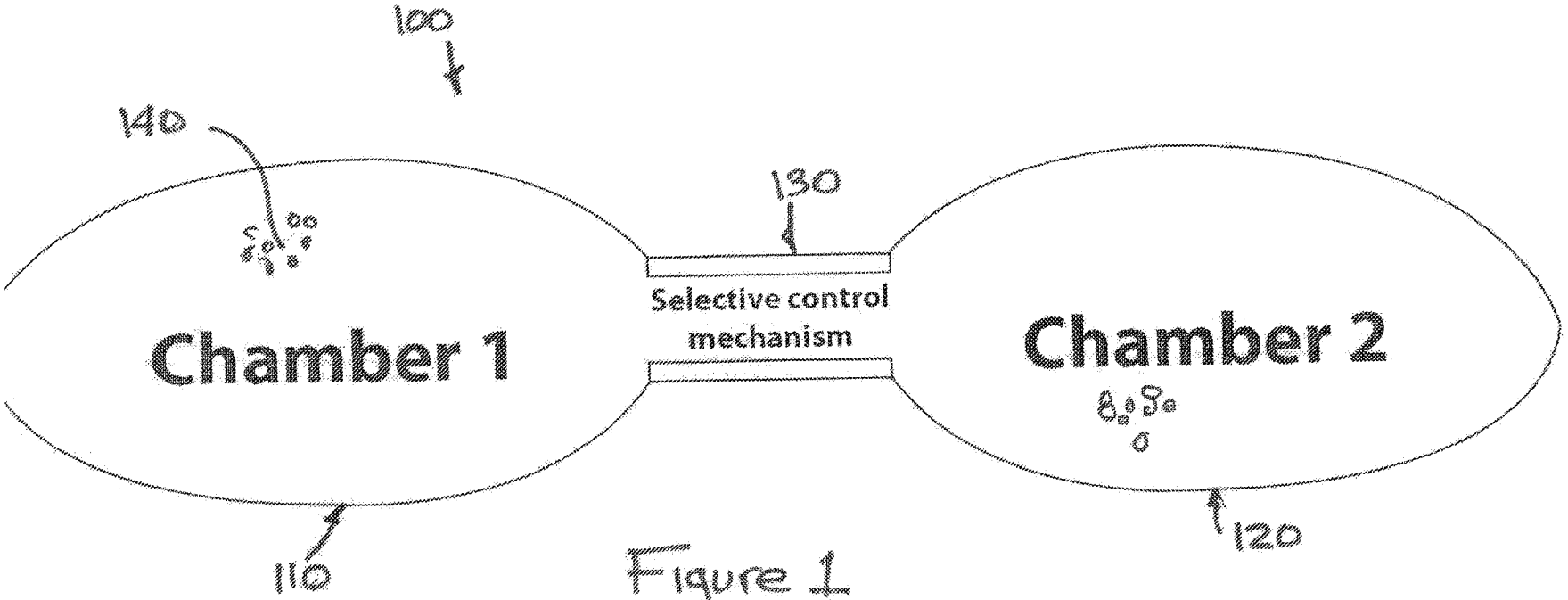
FIG. 1 is a schematic view of a system constructed in accordance with the principles herein.

As illustrated in FIG. 1, a system constructed in accordance with the principles herein is shown generally at 100.

The system is suitable for use in a cushion, pillow, or any other suitable device. The system 100 includes a first chamber, or first reservoir compartment, 110. The first chamber 110 is connected to a second chamber, or second reservoir compartment, 120 via a selective control mechanism 130. The selective control mechanism 130 selectively enables opening and closing of at least one portal 250 of the system 200, as shown in FIG. 2.

The first and second chambers 110, 120, respectively, are prefilled with a suitable fill material 140, and sealed to form closed chambers. The selective control mechanism 130 is connected to the first and second chambers 110, 120 so that fill material 140 can be selectively moved from the first chamber 110 to the second chamber 120 via the selective control mechanism 130.

A system 100 constructed in accordance with the principles herein provides ergonomic/orthopedic improvements on adjustable pillows, by utilizing extended compartments which act as reservoirs for filling.

Figure 2A:
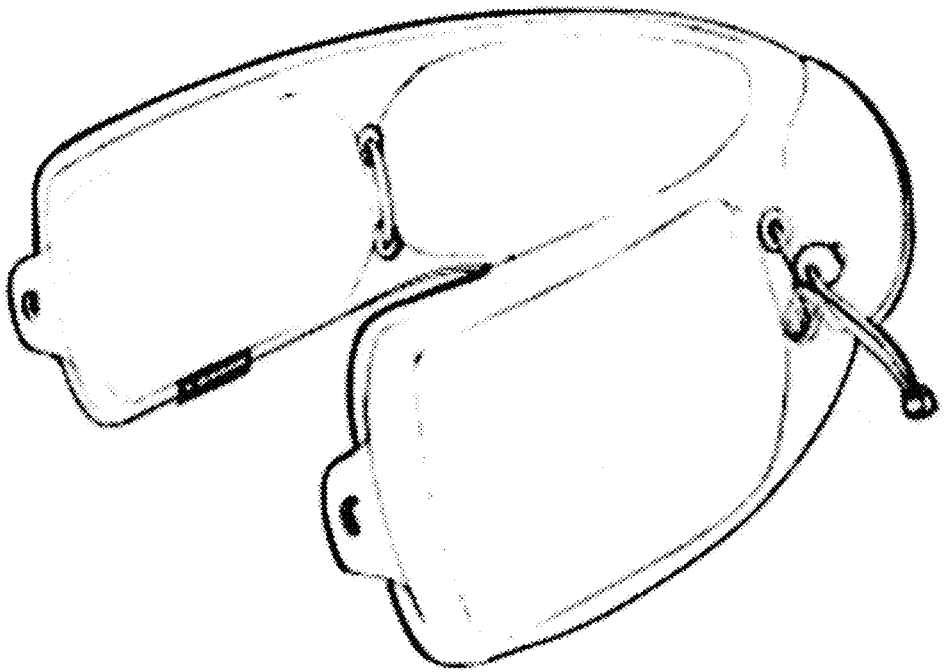
FIGS. 2A-2F are perspective views of an embodiment of a system constructed in accordance with the principles herein.
Figure 2B:
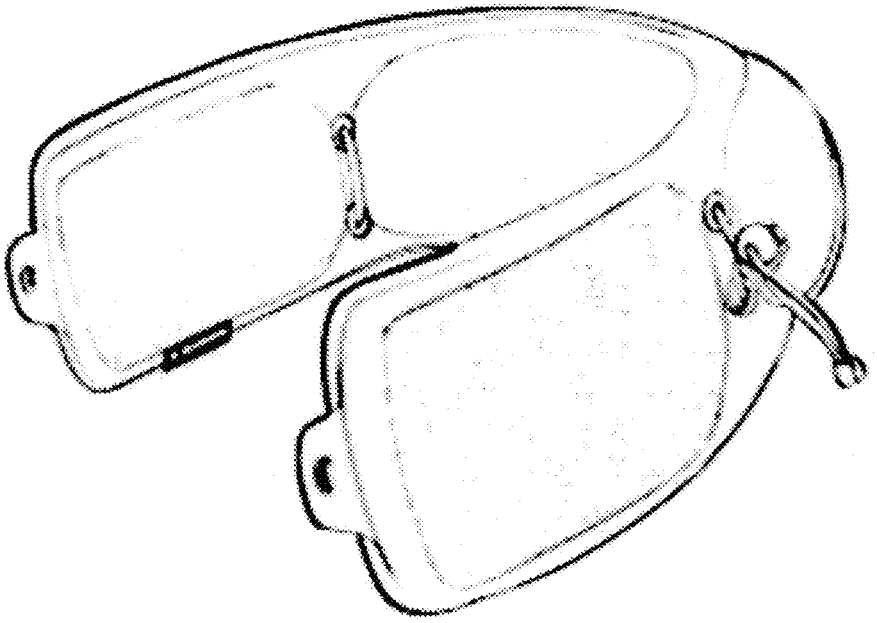
Figure 2C:
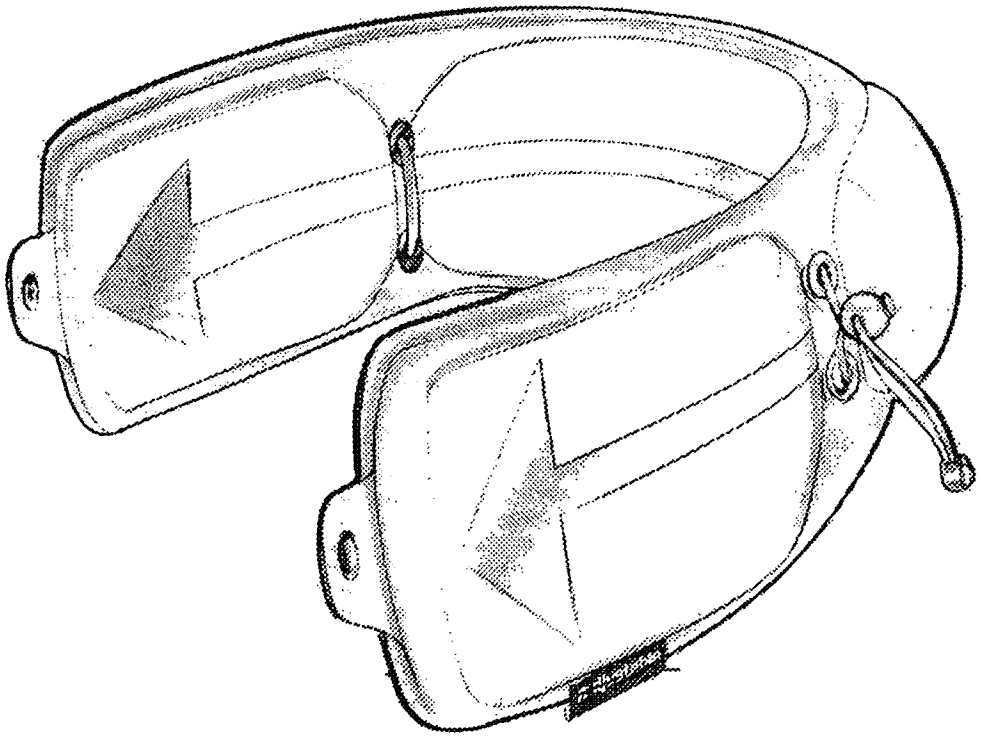
Figure 2D:
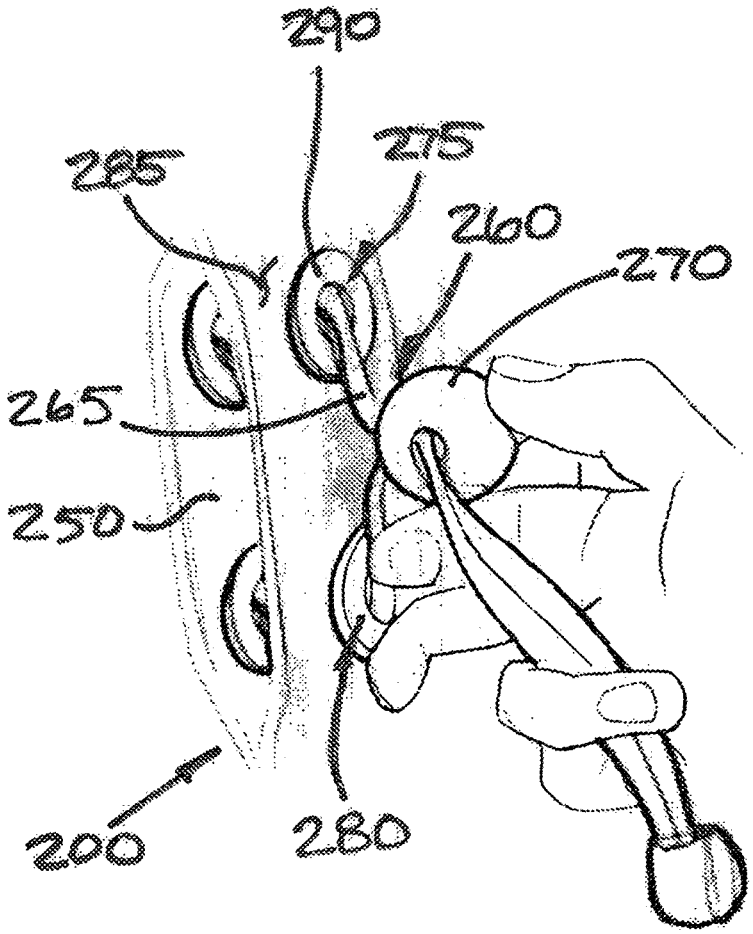
Figure 2E:
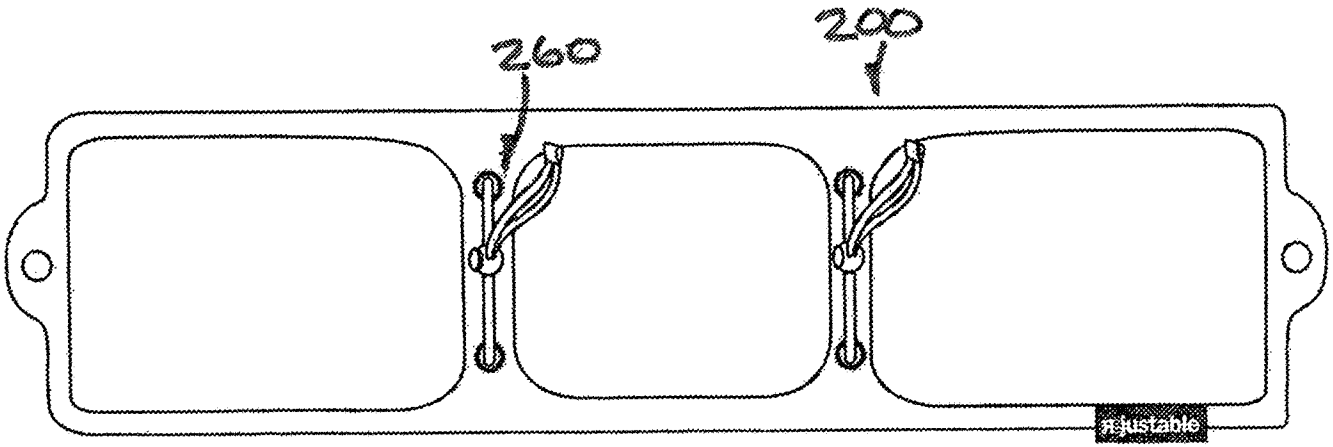
Figure 2F:
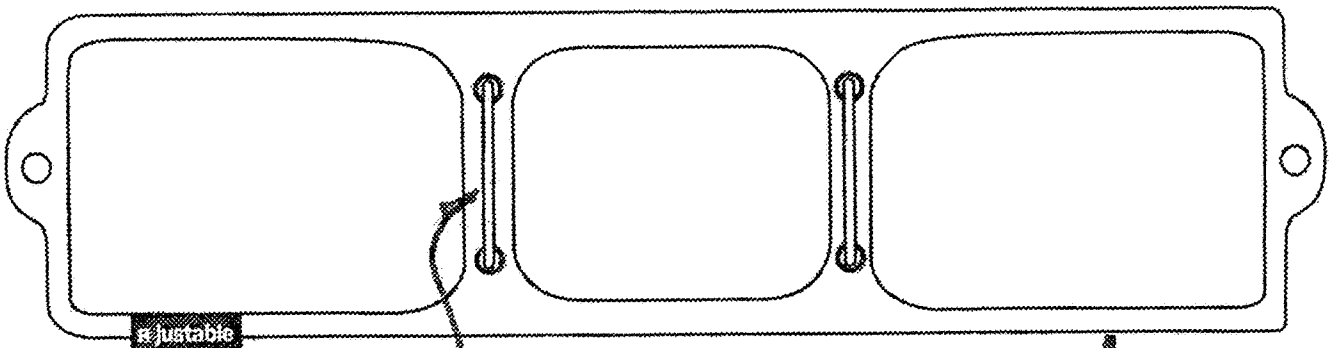

In an embodiment, portal 250 can be fitted with an elastic assembly 260, as illustrated in FIG. 2D. The elastic assembly can include a bungee cord 265, a lock 270 provided on the bungee cord 265, an inlet 275 and an outlet 280 for threading the bungee cord 265 through a cover 285 of the system 200. The inlet 275 and outlet 280 can be sealed using any suitable mechanism, such as, for example, grommets 290 applied to the cover 285. Alternatively, as shown in FIG. 3, portal 350 can include a fully internally located selective closing mechanism 330, such as, for example, magnets, Velcro, an internal elastic or bungee, or any other suitable mechanism for selectively connecting a first chamber 310 and a second chamber 320 of the system 300.

In yet another embodiment, a portal of the system can be selectively operated by a fully external selective control mechanism, such as, for example, a clamping device, a fabric tie, or any other suitable mechanism.

Portal 250 can open and shut internally to allow the user to re-distribute filling until the pillow is the correct circumference for their individual tastes, without having to open the system 200 in order to adjust the firmness of the system 200.

Advantageously, a system constructed in accordance with the principles herein is much simpler to operate than other adjustable systems, such as adjustable pillows. The system is a self-contained unit with an internal mechanism of operation. The system does not require the use of pumps/does not need to be blown up or deflated. The system can be utilized in a number of settings and positions. The system can include a variety of filling materials, such as, for example, absorbent filling. Absorbent filling is advantageous over the use of buoyant pneumatics encased within plastic or rubber. The system will adjust for a broader range of users' shapes and sizes, conforming to fit more naturally. The system can be configured to either alleviate undesired pressure, or provide increased resistance. The system makes use of existing surface area to alleviate undesired pressure and achieve a desired firmness.

Figure 3A:
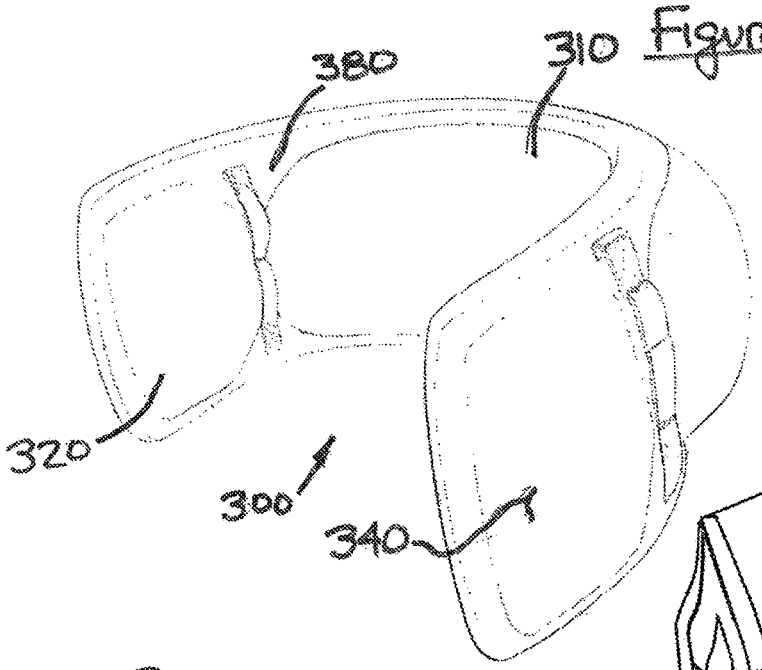
FIGS. 3A-3D are perspective views of yet another embodiment constructed in accordance with the principles herein.
Figure 3B:
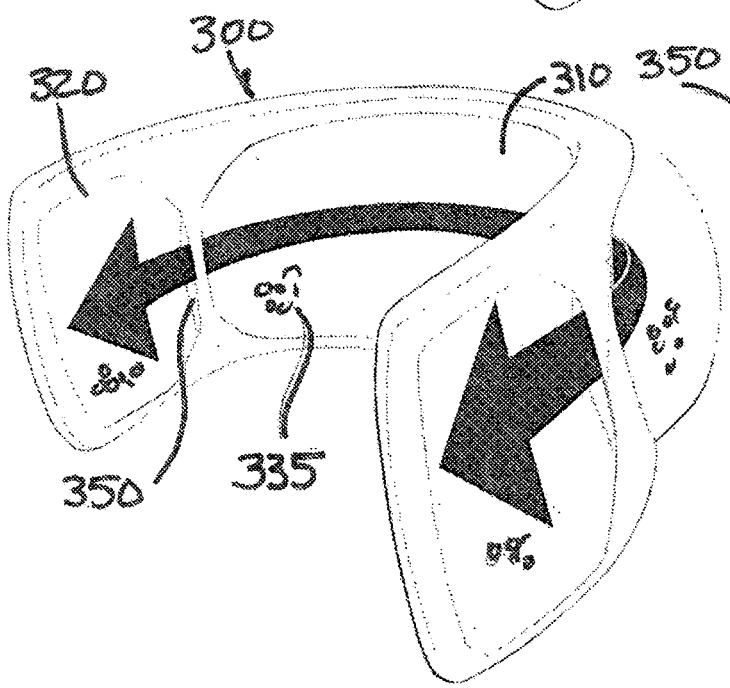

As illustrated in FIGS. 3A-3D, a system shown generally at 300 constructed in accordance with the principles herein can include a one-piece, self-contained unit with a main reservoir compartment, or chamber 310 in the center, and two relief reservoirs, or chambers 320 on either side of the chamber 310. The pillow can have a U shaped curve, and be filled with a suitable fill material, such as, for example micro beads, 335 as shown in FIG. 3B.

Figure 3D:
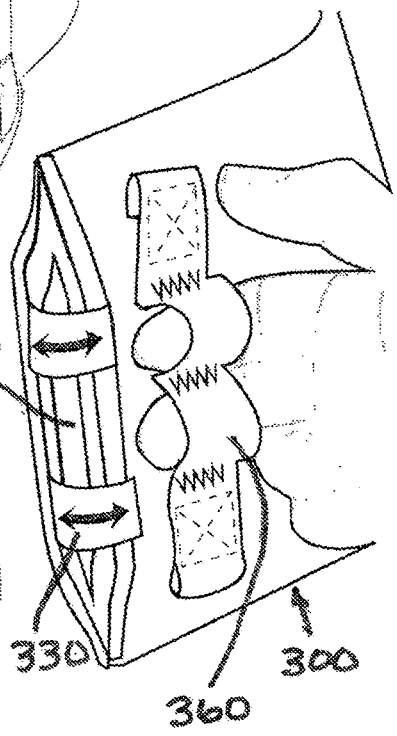
Figure 3C:
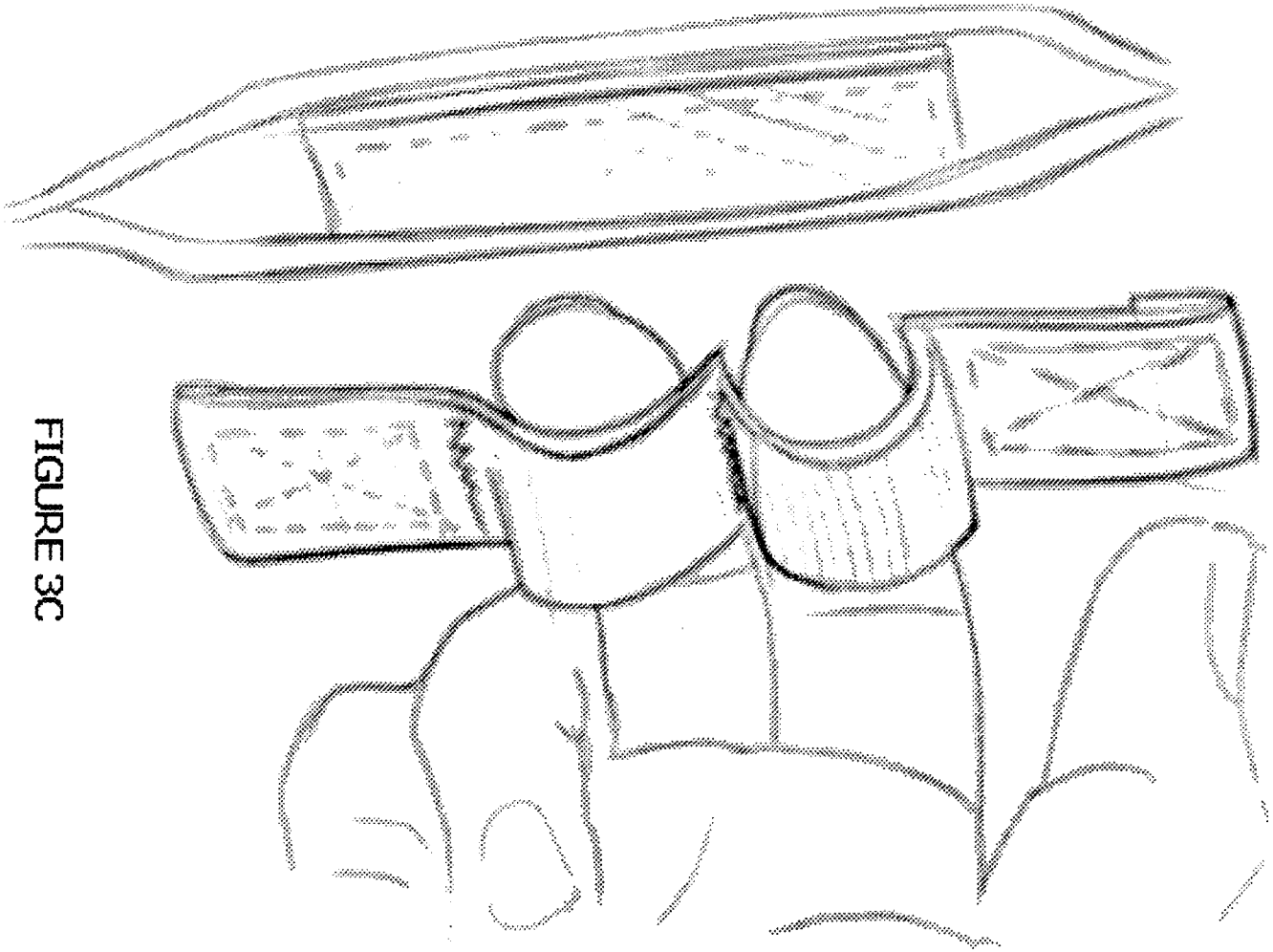

The system 300 can include an outer shell 340 formed of one or more suitable materials, such as, for example, microfiber. Between the main chamber 310 and side reservoirs 320 is a portal 350, shown in more detail in FIG. 3D, which allows for the fill material 335 to be distributed from one compartment, or chamber, to the next. Finger-sized webbing loops 360 on either side of the system 300 can oppose one another, to serve as handles for opening the portal 350. In an embodiment, hook and loop fasteners can be used internally to selectively close the portal 350. Alternatively another suitable internal device, such as, for example, elastic as illustrated in FIG. 3D can be used to selectively close the portal 350. Webbing loops 360 can then be pulled apart, separating hook and loop fasteners and opening the portal 350. Once portal 350 is open, filling 335 is able to flow from one compartment to the next.

A non-adjustable area 370 between the reservoirs can also be filled with a suitable fill material, such as, for example, micro beads, if desired.

Once portal 350 has been opened, filling can be distributed amongst the reservoir compartments 320, allowing the circumference of the pillow to adjust for the user's desired level of resistance, or firmness.

Figures 4A, 4B:
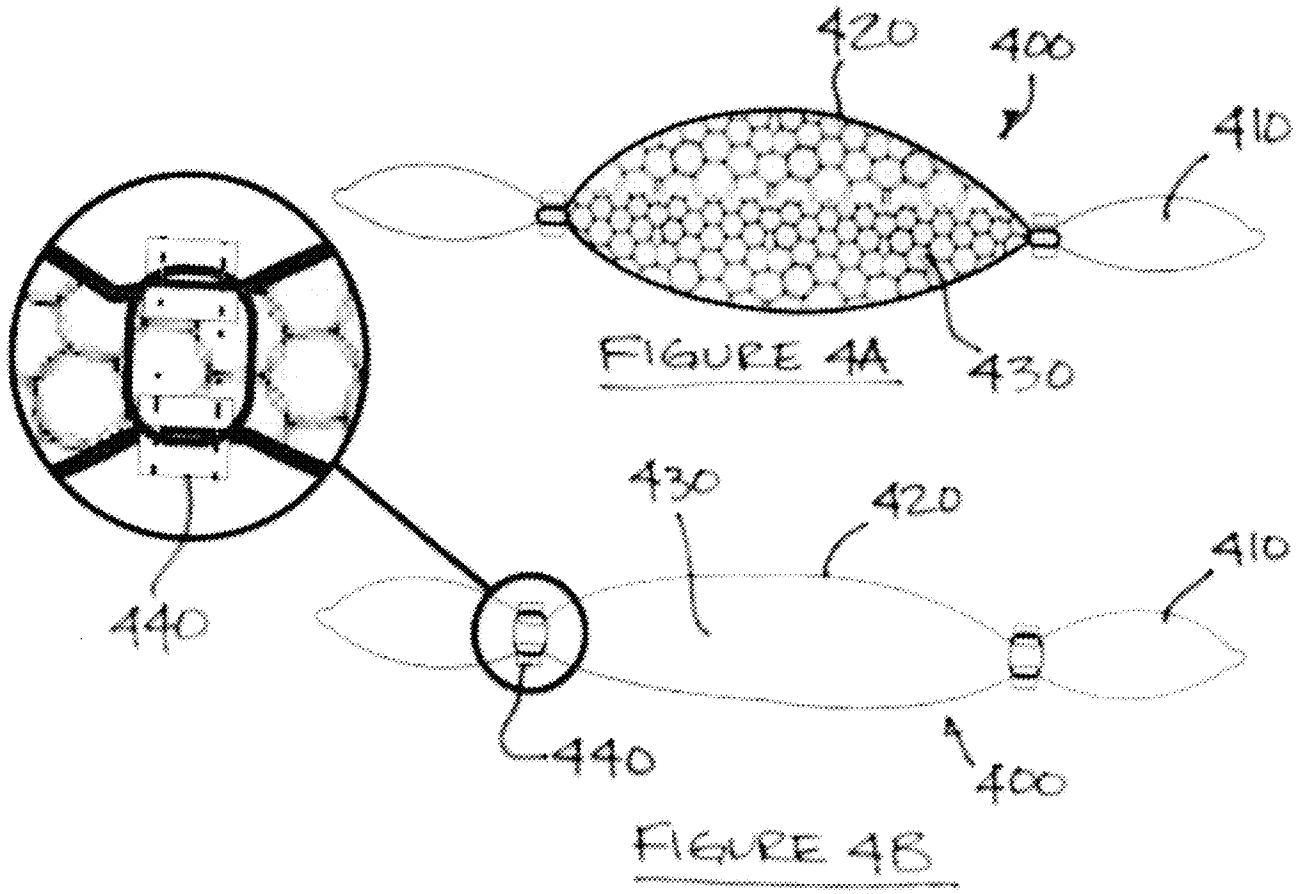
FIGS. 4A-4B sectional views of an embodiment constructed in accordance with the principles herein.

In yet another embodiment constructed in accordance with the principles herein, a system shown generally at 400, in FIGS. 4A and 4B includes chambers, or reservoir compartments 410 formed in a straight cushion, such as, for example, a pillow body. The sectional view illustrated represents an internal view of the three reservoir compartments, including a main reservoir 420 and the reservoirs 410 horizontally bisecting the upper and lower halves of the system 400.

The side reservoir compartments 410 can be emptied and all of filling material, or filling 430 can be moved to rest within the main reservoir compartment 420 without having to readjust the material from inside the system 400. The movement of the filling 430 to the main reservoir 420 results in an overall increase in circumference of the main reservoir 420, thereby adjusting the firmness of the compartment. Portal 440 is then closed maintaining full circumference of the system 400.

FIG. 4B further illustrates that the side reservoir compartments 410 are full, and filling 430 has been distributed throughout the body of the system 400. This results in an overall decrease in circumference of the main reservoir 420. Portal 440 is open, which allows filling 430 to be redistributed at will throughout the system 400.

A few exemplary alternative embodiments constructed in accordance with the principles herein include the following modifications: a) an expandable/adjustable outer shell which allows for filling to be packed looser or tighter; b) portals between reservoir compartments can remain slightly open at all times; c) materials such as elastic or magnets can be used to open/close portals; d) buttons or a draw-string assembly can be used to open/close portals; e) varying the size of main cushion body and reservoirs to allow for greater range of anatomical support; f) reservoir extensions can be rotated to accommodate ergonomic needs of user; g) a straight cushion body; h) varying a shape of the system main reservoir and side reservoirs; i) varying handles for portal opening to allow for varied size pulls; j) system stuffed with a varying range of fillings to allow for multiple instances of therapeutic application; k) an outer shell comprised of a number of different materials; l) a pillow including a non-prefilled reservoir; and m) increasing or decreasing the number of reservoirs.

Figure 5:
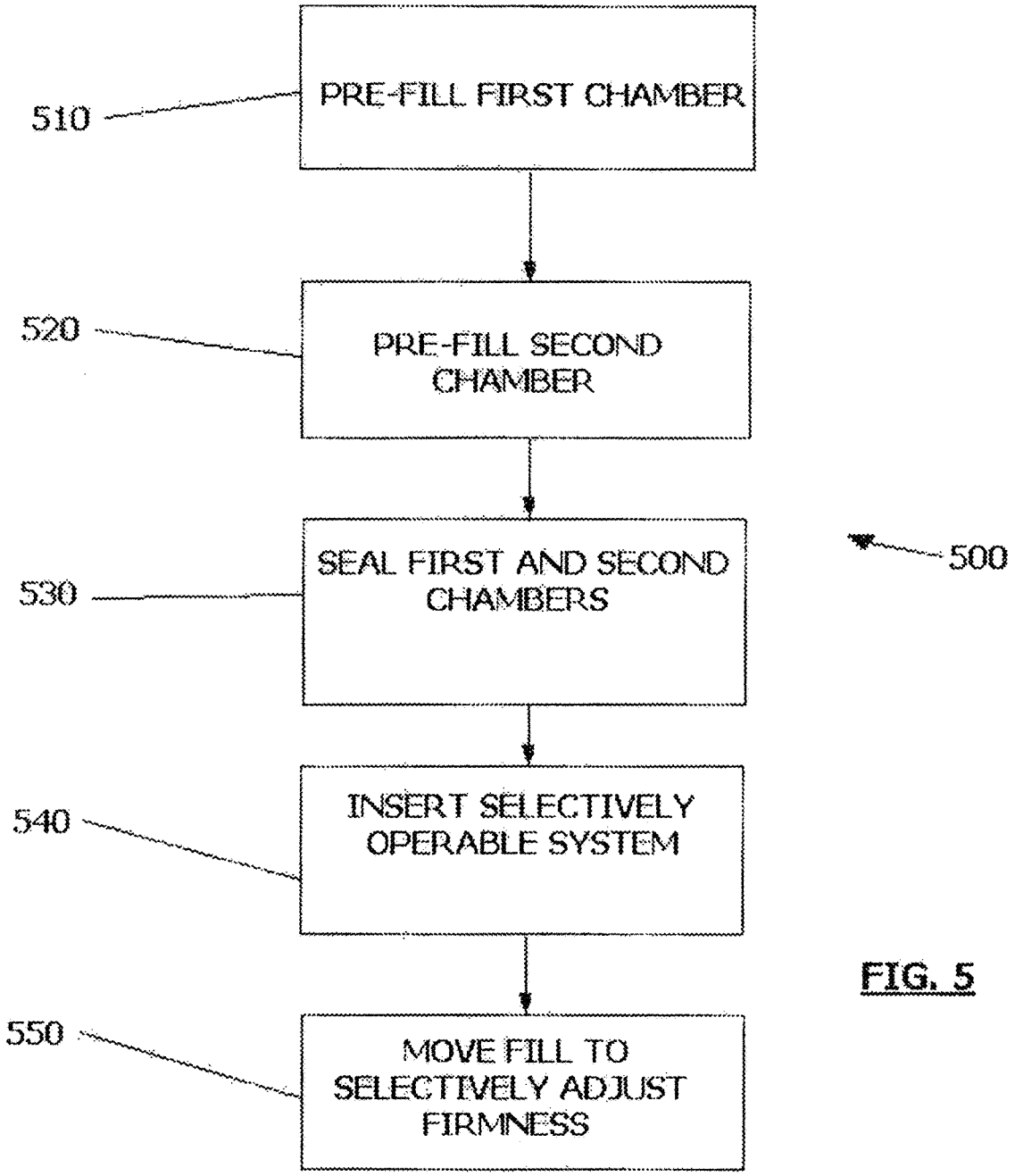
FIG. 5 is a flow chart of a method constructed in accordance with the principles herein. Throughout the various figures, like reference numbers refer to like elements.

As illustrated in FIG. 5, a method of adjusting fill material volume between chambers in a fixed, closed system, shown generally at 500, according to the principles herein can include the following steps. First, a first chamber is prefilled with a fill material at 510. Next, a second chamber is prefilled with the fill material at 520. The first and second chambers are sealed to form the closed system at 530. A selectively operable system is inserted between the first and second chambers at 540. The fill material is selectively movable by selective operation of the selectively operable system to adjust the firmness of the chambers of the system at 550.

In accordance with the principles herein, the term fixed, pre-filled chamber of the system is defined by a chamber that is pre-filled and sealed, and where once sealed, no additional fill material can be added to the system from outside the system.

While the exemplary embodiments of the present disclosure are presently considered to be preferred, various changes and modifications can be made without departing from the spirit and scope of the principles disclosed herein. The scope of the principles disclosed herein is indicated in the appended claims, and all changes that come within the meaning and range of equivalents are intended to be embraced therein.

I claim:

1. A closed cushion system comprising:

a device for selectively opening and closing a foldable connection between adjacent fixed, pre-filled chambers configurable to a generally u-shaped cushion system having a first side housing one of the chambers and a second side housing the other chamber to selectively facilitate flow and blockage of flow of a fill material through a portal between the pre-filled chambers on the first side and the second side, the cushion system configured to generally conform to the neck region of a traveller and to selectively alter the firmness of the pre-filled chambers so that varied amounts of the fill material are movably confined on the first side or on the second side and varied by displacing material from one of the pre-filled chambers to the other pre-filled chamber and closing the foldable connection and portal therebetween via an elastic assembly, the elastic assembly including a bungee cord, a lock, an inlet and an outlet, the portal formed between the inlet and the outlet of the elastic assembly.

2. A closed cushion system as claimed in claim 1, wherein the fill material includes micro beads.

3. A closed cushion system as claimed in claim 1, further comprising at least one additional pre-filled chamber connected to the pre-filled chambers.

4. A closed cushion system as claimed in claim 1, further comprising at least one additional chamber connected to the pre-filled chambers for offloading the fill material from the pre-filled chambers through the portal of the elastic assembly.

5. An adjustable fill system for transferring fill material in a closed system comprising: adjacent chambers configurable to form a generally u-shape pre-filled with the fill material and configured for wear about the neck of a user; and an expandable connecting mechanism disposed between the adjacent chambers, the expandable connecting mechanism selectively expanded to allow at least one of folding of the adjacent chambers and transfer of displaced fill material between the adjacent chambers via a portal formed between an inlet and an outlet of an elastic assembly to facilitate folding or flow of fill material via a control provided on the system, the control configured to secure the fill in the adjacent chambers via the bungee cord and lock of the elastic assembly.

6. An adjustable fill system as claimed in claim 5, wherein at least part of the expandable connecting mechanism is disposed on an exterior of the system.

7. An adjustable fill system as claimed in claim 6, the expandable connecting mechanism further comprising an elastic assembly including a lockable member.

8. An adjustable fill system as claimed in claim 7, wherein the lockable member is further defined by a lockable bungee cord.

9. An adjustable fill system as claimed in claim 8, the expandable connecting mechanism further comprising an inlet and an outlet for adjusting the lockable bungee cord of the expandable connecting mechanism.

10. A method of adjusting fill material volume between chambers in a fixed, closed generally u-shaped cushion system comprising the steps of: prefilling a first chamber with a fill material; prefilling a second chamber with the fill material; sealing the first and second chambers to form the closed system; and inserting a selectively operable system between an inlet and an outlet of an elastic assembly disposed between the first and second chambers, the fill material selectively movable and foldable by selective operation of the selectively operable system wherein fill material can pass through a portal between the inlet and the outlet of the elastic assembly to adjust the firmness of the fill material from the first chamber to the second chamber of the generally u-shaped cushion system by opening to allow flow of material and closing to block the flow and displacement of material between the first and second chambers of the generally u-shaped cushion system via the elastic assembly.

* * * * *